United States Patent [19]

Wohlfarter

[11] 4,222,312

[45] Sep. 16, 1980

[54] APPARATUS FOR MAKING LINED CONTAINERS

[75] Inventor: Helmut Wohlfarter, Schleitheim, Switzerland

[73] Assignee: SIG-Schweizerische Industrie-Gesellschaft, Neuhausen am Rheinfall, Switzerland

[21] Appl. No.: 964,714

[22] Filed: Nov. 29, 1978

[30] Foreign Application Priority Data

Nov. 29, 1977 [CH] Switzerland ..... 14590/77

[51] Int. Cl.[3] ..... B31B 3/74

[52] U.S. Cl. ..... 93/40; 93/36.01; 93/39.1 P; 93/39.2

[58] Field of Search ..... 93/36.01, 54.3, 55.1 P, 93/39.1 P, 40, 43, 54 R, 57, 39.2; 53/175

[56] References Cited

U.S. PATENT DOCUMENTS

| | | | |
|---|---|---|---|
| 878,632 | 2/1908 | Hook | 93/54.3 |
| 1,376,361 | 4/1921 | Sauvage | 93/43 |
| 3,667,351 | 6/1972 | Egli | 93/12 R |
| 3,774,509 | 11/1973 | Heinzer | 53/175 |

FOREIGN PATENT DOCUMENTS

| | | | |
|---|---|---|---|
| 575320 | 5/1976 | Sweden | 93/40 |

*Primary Examiner*—Robert Louis Spruill

*Assistant Examiner*—K. Y. Lin

*Attorney, Agent, or Firm*—Spencer & Kaye

[57] ABSTRACT

An apparatus for making a container having an inner bag and an outer stiff box of prismatic shape and rectangular cross section. The apparatus includes a rotatably supported mandrel wheel having a plurality of radially extending mandrels of rectangular cross section. The mandrel wheel is intermittently advanced to sequentially introduce the mandrels into a plurality of work stations positioned about the mandrel wheel for sequentially working on the containers carried by the mandrels. In one work station each mandrel is provided with a circumferentially closed inner bag; in a successive work station a rigid blank is folded on each mandrel about the inner bag for forming the outer box. Each blank has four lateral sides, a large closing flap extending from one end of each side in the same direction, and a small right-angled flap extending from an opposite end of each side in the same, opposite direction. In a further successive work station a folding and pressing device is provided for forming, by folding and pressing, from two opositely located small right-angled flaps, two oppositely located linear parts of a collar and an inner flange of the outer box. Further, in a successive work station a stripping device is situated for removing the containers from the mandrels.

17 Claims, 8 Drawing Figures

APPARATUS FOR MAKING LINED CONTAINERS

BACKGROUND OF THE INVENTION

This invention relates to an apparatus for making a container which has an inner bag and an outer rigid box and is of prismatic form and rectangular cross section. The apparatus has a mandrel wheel provided with radially outwardly extending mandrels of rectangular cross section. The wheel brings the mandrels sequentially into different work stations to make the container.

Containers are known-as disclosed, for example, in Swiss Pat. No. 575,320-which have an inner bag and an outer rigid box. The containers have a prismatic form and have a rectangular, preferably quadratic cross section. At the top they have a collar which is formed on the outer box and which is glued, with an inner flange thereof, to the upper end wall of the inner bag. The container is filled through the bottom and is thereafter closed, sometimes subsequent to an evacuation of the inner bag. A mass introduction and use of a container of this type has been hindered by the fact that hertofore no appropriate machine for making this type of container has been available. Making such containers manually is, understandably, very expensive.

SUMMARY OF THE INVENTION

It is an object of the invention to provide an apparatus for making a container of the above-outlined type to thus eliminate the discussed disadvantage.

This object and others to become apparent as the specification progresses, are accomplished by the invention, according to which, briefly stated, the apparatus for making a container having an inner bag of prismatic shape and rectangular cross section and an outer stiff box includes a rotatably supported mandrel wheel having a plurality of radially extending mandrels of rectangular cross section. The mandrel wheel is intermittently advanced to sequentially introduce the mandrels into a plurality of work stations positioned about the mandrel wheel for sequentially working on the containers carried by the mandrels. In one work station each mandrel is provided with a circumferentially closed inner bag; in a successive work station a rigid blank is folded on each mandrel about the inner bag for forming the outer box. Each blank has four lateral sides, a large closing flap extending from one end of each side in the same direction, and a small right-angled flap extending from an opposite end of each side in the same, opposite direction. In a further successive work station a folding and pressing device is provided for forming, by folding and pressing, from two oppositely located small right-angled flaps, two oppositely located linear parts of a collar and an inner flange of the outer box. Further, in a successive work station a stripping device is situated for removing the containers from the mandrels.

The apparatus according to the invention is capable of manufacturing containers of the above-outlined type inexpensively and with a high output.

DESCRIPTION OF THE PREFERRED EMBODIMENT

Figure 1:
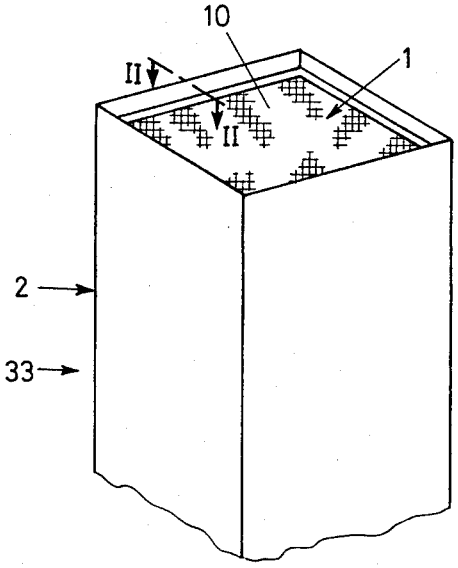
FIG. 1 is a perspective view of a container to be made by the apparatus according to the invention.
Figure 2:
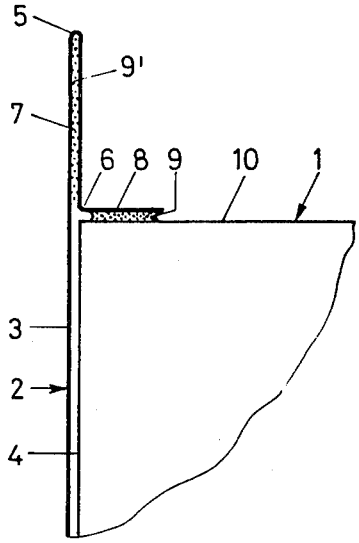
FIG. 2 is a partial sectional view along line II—II of FIG. 1.

Turning now to FIGS. 1 and 2, the container shown therein has a prismatic inner bag 1 having a quadratic cross-sectional outline and a rigid outer box 2 which is also of prismatic configuration and which snugly surrounds the inner bag 1. The lateral faces 3 of the outer box 2 project beyond the lateral faces 4 of the inner bag 1 upwardly and are folded twice; first at 5 inwardly and downwardly by 180° and then for the second time, at 6, inwardy and upwardly by 90°, so that a reinforced collar 7 and an inner flange 8 are formed. The inner flange 8 is bonded to the edge of the upper end face 10 of the inner bag 1 by means of an adhesive layer 9. In certain cases it may be of advantage to provide the reinforcing collar 7 with an adhesive as well in order to bond it to the lateral surface of the outer box 2. The inner bag 1 as well as the outer box 2 are downwardly open when the box leaves the apparatus. The empty container will thereafter be uprighted and filled and closed in a known manner, preferably subsequent to an evacuation of the inner bag.

Figure 3:
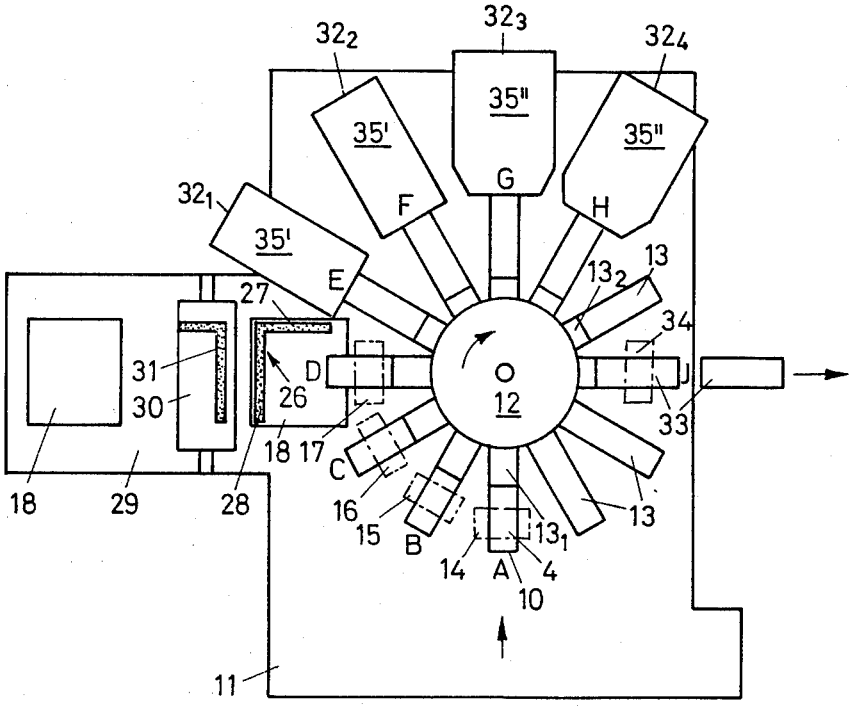
FIG. 3 is a schematic top plan view of a preferred embodiment of the invention.
Figure 8:
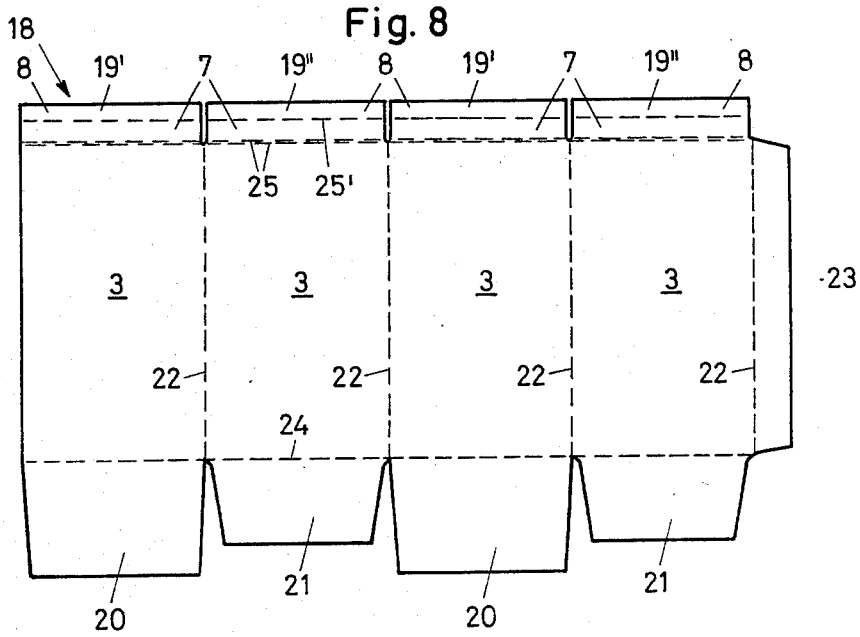
FIG. 8 is a top plan view of a blank of the outer box forming part of the container made with the apparatus according to the invention.

Turning now to FIG. 3, the apparatus for making a container of the above-outlined type has a machine frame 11 which supports a mandrel wheel 12 for rotation about a vertical axis. The mandrel wheel 12 has twelve radially extending folding mandrels 13 of quadratic cross section which are conventionally advanced stepwise to successive, different work stations. The station A has conventional folding means 14 which are shown only as a dash-dotted block. The folding means 14 folds a thin sealable blank which may be an aluminum foil coated with a plastic layer, onto the mandrel $13_1$ so that the lateral surfaces 4 of the inner bag 1 lie in a face-to-face contact with the outer surface of the mandrel. Thereafter, the upper end face 10 of the inner bag 1 too, is folded onto the end face of the mandrel $13_1$. The folded parts of the inner bag 1 are then welded with one another in an airtight manner in subsequent stations B and C with known welding means 15 and 16. In the subsequent station D the folding means 17 folds a cardboard blank 18 about the outer faces of the inner bag 1. The cardboard blank 18 is shown in FIG. 3 only as a rectangle; it has, in reality, a shape as shown in FIG. 8 and thus has on one side four small rectangular projecting flaps 19', 19'', whereas on the other side, it has two pairs of large, approximately rectangular, projecting flaps 20 and 21. Score lines 22 separate the lateral faces 3 from one another or, as the case may be, from a rectangular closing flap 23. A further score line 24 serves for facilitating the folding of the large flaps 20 and 21 which, subsequent to filling the container, constitute the bottom thereof. Score lines 25 and 25' serve to facilitate the folding of the small flaps 19', 19'' from which the collar 7 and the inner flange 8 are formed.

As shown in FIG. 3, the blank 18 is provided with an L-shaped adhesive layer pattern 26, the leg 27 of which extends over the closing flaps 23 while its leg 28 covers the collar portions 7 and the flange portions 8 of the flaps 18 to thus constitute adhesive layers 9, 9' shown in FIG. 2. Dependent upon the thickness and quality of the blank 18, it may be possible, however, to dispense with the adhesive layer.

In the adhesive layer pattern shown in FIG. 3, the closing flap 23 constitutes, in the finished container, the outer side of the seam. In case it is of importance that the flap 23 constitute the inner face of the seam, the leg 27 of the adhesive pattern has to extend from the other end of the leg 28.

Advantageously, the leg 27 of the adhesive pattern 26 is wider than the closing flap 23 in order to also ensure a connection between the lateral parts of the bag 1 and the outer box 2.

The machine frame 11 has a feed track 29 on which the cardboard blanks 18 are advanced to the folding means 17 of the station D by conventional conveying means, not shown. During this conveyance, the blanks 18 pass underneath an applicator roll 30 carrying an L-shaped adhesive pattern which is continuously replenished with adhesive by means of another, non-illustrated roll in a known manner and which applies the adhesive pattern to the blank 18.

At the subsequent stations E, F, G and H there are provided four identically structured folding and pressing devices 32 which form the collar 7 and the annular flange 8 from the small rectangular flaps 19', 19''. During this operation the first device $32_1$ folds the two opposite flaps 19' and presses them together in the folded position. The second device $32_2$ effects only a post-folding and post-pressing operation on the two flaps 19'. The third device $32_3$ is offset by 90° with respect to the devices $32_1$ and $32_2$ and thus grasps the two opposite flaps 19'' which then are post-folded and post-pressed by the device $32_4$ which is arranged similarly to the device $32_3$. As the container 33 leaves the station H on the mandrel $13_2$ it has a configuration as shown in FIG. 1. In the station J the container is removed by means of a stripping mechanism 34 from the mandrel and is then further conveyed to conventional filling and closing stations. In a closing station, the inner bag 1 is closed and sealed airtight (if expedient, subsequent to evacuation), while a further closing station folds and glues to one another the flaps 20 and 21 of the outer box. For opening the container, the upper end face 10 of the inner bag 1 is cut along the inner flange 8. For reclosing the opened container, a lid may be inserted on the upper reinforced collar 7 of the outer box 2.

The structure and function of the folding and pressing devices 32 will now be discussed in detail in conjunction with FIGS. 4, 5, 6 and 7.

Figure 4:
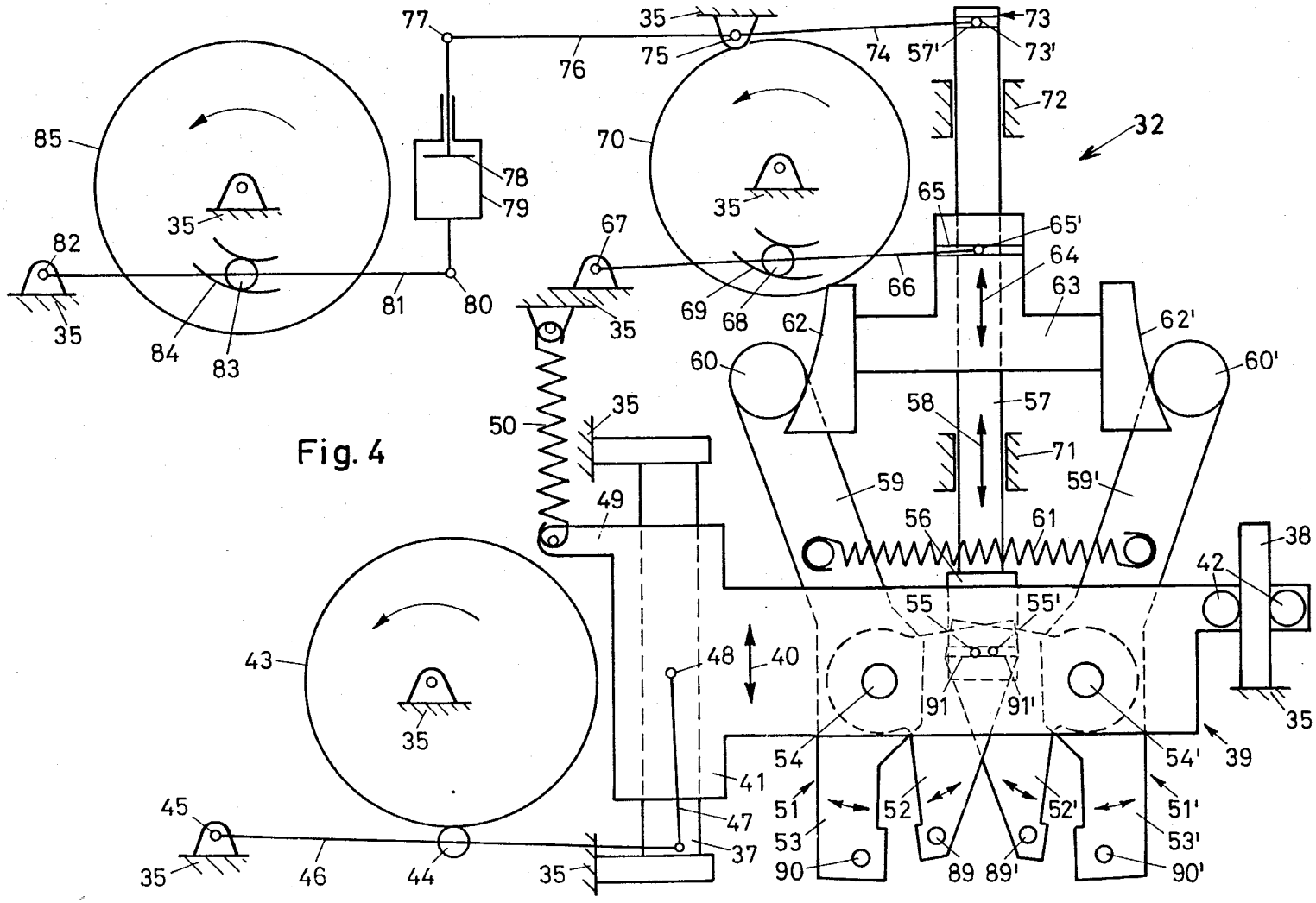
FIG. 4 is a schematic elevational view of a detail of the preferred embodiment.

The device 32 has a prismatic housing of rectangular cross section. FIG. 4 shows only some parts 35 of the housing in a schematic manner. In FIG. 3 the narrow housing side 35' of the devices $31_1$ and $31_2$ and the wide housing side 35'' of the devices $32_3$ and $32_4$ are visible. To the housing 35 there are affixed two parallel guide posts 37 and 38 on which a carriage 39 is displaceable in the direction indicated by the double-headed arrow 40. The carriage 39 has, for this purpose, a guide sleeve 41 which surrounds the circular guide post 37 and two guide rollers 42 which, in turn, engage the prismatic guide post 38. For driving the carriage 39 there is provided an open cam disc 43 which cooperates with a follower roller 44 which, in turn, is arranged on a lever 46 pivotally supported at 45. The end of the lever 46 is articulated at 48 to the guide sleeve 41 with the intermediary of a pull rod 47. A tension spring 50 attached to the sleeve 41 at a projection 49 maintains the follower roller 44 in contact with the periphery of the cam disc 43.

On the carriage 39, there are arranged two symmetric grippers 51 and 51', each having an inner jaw (folding jaw) 52 and, respectively, 52' and an outer jaw (counter jaw) 53 and, respectively, 53'. The jaws 52 and 53, as well as 52' and 53' are pivotally arranged on respective separate pins 54 and 54' which, in turn, are affixed to the carriage 39. The folding jaws 52 and 52' each carry a respective roller 55 and 55' which project into a groove 91 and 91', respectively, arranged on the head 56 of a rod 57. The rod 57 is movable in the direction of the double-headed arrow 58 and serves for actuating the folding jaws 52 and 52'. For actuating the counter jaws 53 and 53', on the rearwardly extending projections 59 and 59' of the counter jaws, there are provided follower rollers 60 and 60' which are maintained in contact with two symmetrical control cams 62 and 62' by means of a tension spring 61 attached to the extensions 59 and 59'. The control cams 62 and 62' are arranged on a slide 63 which is movable on and with respect to the rod 57 in a direction as indicated by the double-headed arrow 64. The slide 63 is provided with a groove 65 into which extends a roller 65' arranged at the end of a lever 66. The lever 66 is pivotally secured to the housing 35 at 67 and carries a follower roller 68 which, in turn, is guided in a closed, only partially shown groove 69 of a cam disc 70.

The rod 57 which is displaceable in guides 71 and 72 affixed to the housing, is articulated at 73 to an arm 74 of a lever 74, 76 which is pivotally supported at 75 in the housing 35. The other arm 76 of the lever 74, 76 is articulated at 77 to a piston 78 of a pneumatic cylinder-and-piston assembly 78, 79, whose cylinder 79 is, in turn, articulated at 80 to a lever 81. The cylinder-and-piston assembly 78, 79 is, in a manner conventional by itself, connected to a source of compressed air, whose pressure may be set for determining the force for the rod 57 to thus set the compressing force of the jaws 52, 52'. The jointed connection between the arm 74 and the rod 57 is effected by a roller 73' which is carried at one end of the arm 74 and which engages into a groove 57' provided in the rod 57. The lever 81 is pivotally supported at 82 and carries a follower roller 83 which is guided in a closed groove 84 (only partially shown) of a cam disc 85. It is seen that upon rotation of the cam disc 85, the rod 57 reciprocates in the direction of the double-headed arrow 58 and further, if the rod 57 moves downwardly (as viewed in FIG. 4), the folding jaws 52 and 52' are moved in the direction of the arrows towards their respective counter jaws 53, 53', that is, in the closing direction of the grippers 51 and 51', provided that the carriage 39 does not simultaneously move equally fast or faster downwardly, driven by the eccentric cam disc 43. It is further seen that in case the cam disc 70 moves the slides 63 upwardly at a greater speed than the speed of the upwardly moving carriage 39, then the control cams 62 and 62' spread apart the follower rollers 60 and 60'; this results in a closing motion of the counter jaws 53 and 53'.

Figure 7:
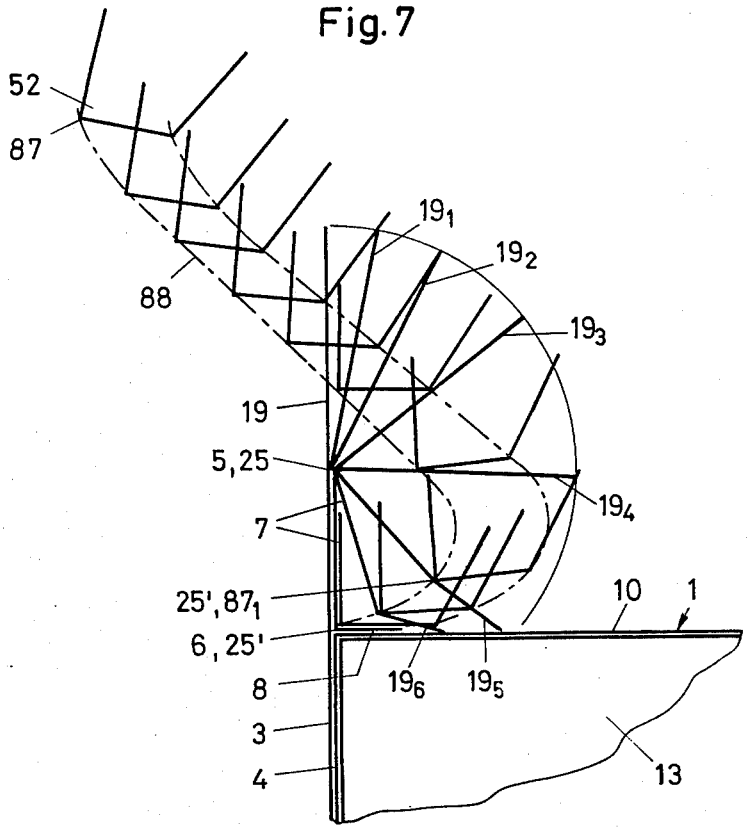
FIG. 7 is a diagrammatic view of the sequential operation of a component illustrated in FIG. 4.

The amplitudes and phases of the cyclical reciprocating motions indicated by the arrows 40, 58 and 64 of the carriage 39, the rod 57 and the slide 63 are effected by the synchronously rotating cam discs 43, 70 and 85 in such a manner that as the carriage 39, during its downward motion as viewed in FIG. 4, approaches the end face of the mandrel 13 which carries the inner bag 1 and the unfinished outer box 2, the outer corner 87 of the folding jaw 52 describes an approximately S-shaped curve 88 as shown in FIG. 7. During this occurrence, the folding jaw 52, with that side which is oriented away from the counter jaw 53, engages the projecting flap 19 of the respective lateral side 3 of the outer box and folds the projecting flap 19 in order to bring the side-by-side arranged score lines 25 (FIG. 8) successively into the positions $19_1$ through $19_5$. At the same time, the flap 19 still remains flat. Shortly before assuming the position $19_5$, the corner $87_1$, however, contacts the score line 25' and folds the flap 19 which abuts the end face 10 of the inner bag 1, to form a linear part of the collar 7 and the inner flange 8.

Figure 5:
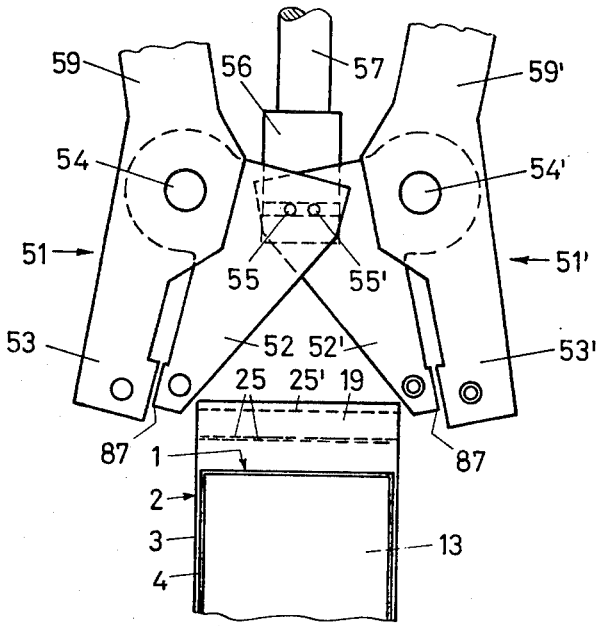
FIGS. 5 and 6 are side elevational views of two end positions of a component of the structure illustrated in FIG. 4.

In FIG. 5, the position of the grippers 51 and 51' is shown immediately prior to their engagement with the flap 19, whereas in FIG. 9 there is shown the closed state of the grippers in their closest position to the mandrel 13. It is seen that in the FIG. 6 position, the counter jaw 53 has engaged the external side of the lateral surface 3 of the box 2, so that now the jaws 52 and 53 press firmly to one another the collar 7 and the projecting part of the lateral face 3, while the inner flange 8 of the box 2 is pressed onto the end wall 10 of the inner bag 1. The return motion of the grippers 51 and 51' into the starting position needs no detailed description. The thin adhesive layers 9 and 9' are, for the sake of simplicity, not shown in FIGS. 5, 6, and 7.

After the two small flaps 19' have been folded and pressed by the device $32_1$, the same jaw motion is repeated by the apparatus $32_2$ to counteract any tendency of resilient return motion of the parts 7 and 8 and to ensure that the adhesive layer 9 takes effect. The devices $32_3$ and $32_4$ perform the same operation on the flaps 19'', so that the collar 7 and the inner flange 8 are completed on all four sides and the container 33 which is to be subsequently filled and closed at the bottom can be removed from the mandrel 13.

Figure 6:
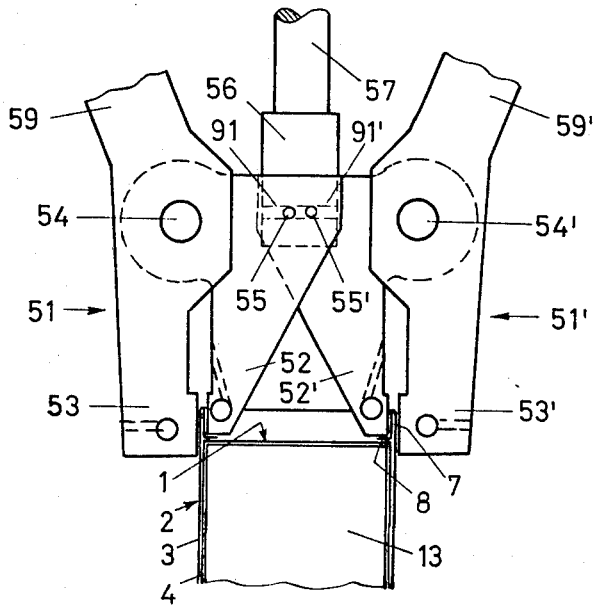

The jaws 52, 53 and 52', 53' are provided in the vicinity of their working ends with holes 89, 90 and 89', 90' for accommodating heating bodies or for circulating a coolant therein. Such heating bodies (electric heating cartridges with conventional wire connections) are illustrated in FIG. 5 with an inner circle placed into the holes 89' and 90' of the respective jaws 52' and 53'. On the other hand, the holes in the jaws 52, 53, 52' and 53' shown in FIG. 6 may form ducts for a coolant, such as water which, by conventionally arranged ducts may be introduced at the front and may be withdrawn at the rear. If a "hotmelt"-type adhesive is used, the gripper jaws of the device $32_1$ may be provided with a heater body in order to bring the adhesive of the required adhesion temperature, while at the same time, the gripper jaws of the device $32_2$ are cooled with water to ensure a firm holding effect of the adhesive layer 9. Dependent upon the material of the outer box 2 and the type of adhesive used (a wide variety of adhesives may find application) and further, dependent upon the length of time the grippers 51 and 51' are maintained in their closed position as shown in FIG. 6, it may be feasible to utilize only two devices $32_1$ and $32_2$, while the post-pressing devices $32_2$ and $32_4$ can be dispensed with. In case the rectangular cross section of the container 33 is not quadratic but has sides of unequal length, the devices $32_3$ and $33_4$ differ from the devices $32_1$ and $32_2$ in that the gripper jaws 52, 53 and 52', 53' are of different width.

The structure of components 13 through 17 and 34 are known in the art. Thus, for example folding means 14, 17 and folding mandrels 13 are shown as single realization in U.S. Pat. No. 3,667,351 and as twofold realization in Swiss Pat. No. 500,098. Welding means 15, 16 are known from U.S. Pat. No. 3,085,478 and stripping mechanism 34 is shown in U.S. Pat. No. 3,765,308.

It is to be understood that the above description of the present invention is susceptible to various modifications, changes and adaptations and the same are intended to be comprehended within the meaning and range of equivalents of the appended claims.

What is claimed is:

1. In an apparatus for making a container having an inner bag and an outer stiff box of prismatic shape and rectangular cross section and being formed from a rigid blank having four lateral sides, a large closing flap extending from one end of each side in the same direction, and a small rectangular flap extending from an opposite end of each side in the same direction which is opposite to the direction in which the large closing flaps extend; the apparatus including a rotatably supported mandrel wheel having a plurality of radially extending mandrels of rectangular cross section; a plurality of work stations positioned about the mandrel wheel for sequentially working on the containers introduced into the respective station by the mandrels upon intermittent advance of the mandrel wheel; the improvement comprising (a) first means situated in a first work station for providing each mandrel with a circumferentially closed inner bag;

(b) second means situated in a second work station, located downstream of said first work station as viewed in the direction of the intermittent rotary advance of said mandrels, for folding the rigid blanks on each mandrel about the inner bag for forming said outer box;

(c) a folding and pressing device situated in a third work station located downstream of said second work station for forming, by folding and pressing, from small rectangular flaps, linear parts of a collar and an inner flange of the outer box; said folding and pressing device including two grippers each having first and second jaws for engaging two oppositely located said small rectangular flaps of the outer box supported on the respective mandrel, first drive means connected to said grippers for cyclically reciprocating said grippers as a unit and second and third drive means connected to said first and second jaws of said grippers for cyclically opening and closing said grippers in unison; each drive means having a driving member and the driving members being independent from one another and running synchronously; and (d) a stripping means situated in a fourth work station located downstream of said third work station for removing the containers from said mandrels.

2. In an apparatus for making a container having an inner bag and an outer stiff box of prismatic shape and rectangular cross section and being formed from a rigid blank having four lateral sides, a large closing flap extending from one end of each side in the same direction, and a small rectangular flap extending from an opposite end of each side in the same direction which is opposite to the direction in which the large closing flaps extend;

the apparatus including a rotatably supported mandrel wheel having a plurality of radially extending mandrels of rectangular cross section; a plurality of work stations positioned about the mandrel wheel for sequentially working on the containers introduced into the respective station by the mandrels upon intermittent advance of the mandrel wheel; the improvement comprising (a) first means situated in a first work station for providing each mandrel with a circumferentially closed inner bag;

(b) second means situated in a second work station, located downstream of said first work station as viewed in the direction of the intermittent rotary advance of said mandrels, for folding the rigid blanks on each mandrel about the inner bag for forming said outer box;

(c) a folding and pressing device situated in a third work station located downstream of said second work station for forming, by folding and pressing, from small rectangular flaps, linear parts of a collar and an inner flange of the outer box; said folding and pressing device including (1) a carriage supported in said device for reciprocating motion towards and away from a mandrel dwelling in said third work station;

(2) two flap grippers each formed of a pair of jaws pivotally attached to said carriage at spaced locations; said grippers being arranged symmetrically with respect to one another; in each of said grippers one of said jaws being an inner, folding jaw;

(3) first drive means for reciprocating said carriage with said grippers as a unit; and (4) second drive means for opening and closing the jaws of said grippers in unison for folding and pressing two oppositely located said small rectangular flaps of the outer box carried on said mandrels; said second drive means including a rod having a head; means for articulating the folding jaws to said head and means for reciprocating said rod parallel to the direction of motion of said carriage and with a phase and amplitude different from those of the motion of said carriage; and (d) a stripping means situated in a fourth work station located downstream of said third work station for removing the containers from said mandrels.

3. In an apparatus for making a container having an inner bag and an outer stiff box of prismatic shape and rectangular cross section and being formed from a rigid blank having four lateral sides, four large closing flaps extending from one end of the respective lateral side in the same direction, and first, second, third and fourth small rectangular flaps extending from an opposite end of the respective lateral side in the same direction; the small flaps being arranged in the pattern of a rectangle wherein the first small flap in parallel and opposite to the second flap and the third small flap is parallel and opposite to the fourth small flap; the apparatus including a rotatably supported mandrel wheel having a plurality of radially extending mandrels of rectanguiar cross section; a plurality of work stations positioned about the mandrel wheel for sequentially working on the containers introduced into the respective station by the mandrels upon intermittent advance of the mandrel wheel; the improvement comprising (a) first means situated in a first work station for providing each mandrel with a circumferentially closed inner bag;

(b) second means situated in a second work station, located downstream of said first work station as viewed in the direction of the intermittent rotary advance of said mandrels, for folding the rigid blanks on each mandrel about the inner bag for forming said outer box;

(c) a first folding and pressing means situated in a third work station located downstream of said second work station for engaging said first and second small flaps for folding a first portion of said first and second small flaps inwardly over a marginal portion of the associated side of the outer box carried on the mandrel, for folding a second portion of said first and second small flaps to extend inwardly away from the associated side and for pressing said first portion of said first and second small flaps against said marginal portion of the associated side, whereby oppositely located first and second linear parts of a collar and inwardly extending, oppositely located first and second flanges of the outer box are formed; said first folding and pressing means including (1) a first carriage supported in said first folding and pressing means for reciprocating motion towards and away from a mandrel dwelling in said third work station;

(2) first flap grippers each formed of a pair of jaws pivotally attached to said first carriage;

(3) first drive means for reciprocating said first carriage with said first flap grippers as a unit; and (4) second drive means for opening and closing the jaws of said first flap grippers for folding and pressing said first and second small flaps of the outer box carried on said mandrels;

(d) a second folding and pressing means situated in a fourth work station located downstream of said third work station for engaging said third and fourth small flaps for folding a first portion of said third and fourth small flaps inwardly over a marginal portion of the associated side of the outer box carried on the mandrel, for folding a second portion of said third and fourth small flaps to extend inwardly away from the associated side and for pressing said first portion of said third and fourth small flaps against said marginal portions of the associated side, whereby oppositely located third and fourth linear parts of a collar and inwardly extending, oppositely located third and fourth flanges of the outer box are formed; said second folding and pressing means including (1) a second carriage supported in said second folding and pressing means for reciprocating motion towards and away from a mandrel dwelling in said forth work station;

(2) second flap grippers each formed of a pair of jaws pivotally attached to said second carriage;

(3) third drive means for reciprocating said second carriage with said second flap grippers as a unit; and (4) fourth drive means for opening and closing the jaws of said second flap grippers for folding and pressing said third and fourth small flaps of the outer box carried on said mandrels; and (e) a stripping means situated in a fifth work station located downstream of said fourth work station for removing the containers from said mandrels.

4. In an apparatus for making a container having an inner bag and an outer stiff box of prismatic shape and rectangular cross section and being formed from a rigid blank having four lateral sides, a large closing flap extending from one end of each side in the same direction, and a small rectangular flap extending from an opposite end of each side in the same direction which is opposite to the direction in which the large closing flaps extend; the apparatus including a rotatably supported mandrel wheel having a plurality of radially extending mandrels of rectangular cross-section; a plurality of work stations positioned about the mandrel wheel for sequentially working on the containers introduced into the respective station by the mandrels upon intermittent advance of the mandrel wheel; the improvement comprising (a) first means situated in a first work station for providing each mandrel with a circumferentially closed inner bag;

(b) second means situated in a second work station, located downstream of said first work station as viewed in the direction of the intermittent rotary advance of said mandrels, for folding the rigid blanks on each mandrel about the inner bag for forming said outer box;

(c) a folding and pressing means situated in a third work station located downstream of said second work station for folding a first portion of each said small rectangular flap inwardly over a marginal portion of the associated side of the outer box carried on said mandrel, for folding a second portion of each said small rectangular flap to extend inwardly away from the associated side and for pressing said first portion of each said small rectangular flap against said marginal portion of the associated side, whereby a collar and inwardly extending flanges of the outer box are formed; said folding and pressing means including (1) a carriage supported in said folding and pressing means for reciprocating motion towards and away from a mandrel dwelling in said third work station;

(2) a flap gripper formed of a pair of jaws pivotally attached to said carriage;

(3) first drive means for reciprocating said carriage with said flap gripper as a unit; and (4) second drive means for opening and closing the jaws of said flap gripper for folding and pressing each said small rectangular flap of the outer box carried on said mandrels; and (d) a stripping means situated in a forth work station located downstream of said third work station for removing the containers from said mandrels.

5. An apparatus as defined in claim 4, wherein said folding and pressing means includes two flap grippers for engaging two oppositely located said small rectangular flaps of the outer box supported on the respective mandrel.

6. An apparatus as defined in claim 5, wherein the jaw pairs of said two flap grippers are pivotally attached to said carriage at spaced locations and further wherein said flap grippers are arranged symmetrically with respect to one another; said second drive means being arranged for opening and closing the jaws of said two flap grippers in unison for folding and pressing two oppositely located small rectangular flaps of the outer box carried on said mandrels.

7. An apparatus as defined in claim 4, further comprising an additional folding and pressing means situated in an additional work station located downstream of an adjoining said third work station for folding and pressing the same said rectangular flaps which were previously handled by the folding and pressing means situated in said work station.

8. An apparatus as defined in claim 4, wherein said mandrels have a quadratic cross section.

9. An apparatus as defined in claim 4, further comprising means for applying a patterned adhesive layer to each blank for bonding one closing flap to a lateral side and for bonding the inner flange to an end face of the respective inner bag.

10. An apparatus as defined in claim 9, wherein the adhesive layer has an L-shape.

11. An apparatus as defined in claim 10, wherein the width of one leg of the patterned adhesive layer is sufficiently large to cover the four small rectangular flaps along their entire width.

12. An apparatus as defined in claim 6, wherein each jaw has a bore hole for receiving a heater element.

13. An apparatus as defined in claim 6, wherein each jaw has a bore hole for guiding a coolant therein.

14. An apparatus as defined in claim 2, wherein in each of said grippers the other of said jaws is an outer, counter jaw and wherein said drive means further includes two control cams displaceable as a unit and operatively connected with said counter jaws; means for reciprocating said control cams parallel to the direction of motion of said carriage and with a phase and amplitude different from those pertaining to the motion of said carriage for effecting pivotal motion of each said outer jaw about its respective articulation to said carriage.

15. An apparatus as defined in claim 14, further comprising a spring urging said outer jaws away from one another and into continuous contact with the respective said control cam.

16. An apparatus as defined in claim 14, wherein said drive means for reciprocating said carriage includes a first rotating cam disc operatively connected to said carriage; further wherein said means for reciprocating said rod includes a second rotating cam disc operatively connected to said rod and further wherein said means for reciprocating said control cams includes a third rotating cam disc operatively connected to said control cams; said first, second and third cam discs being rotated in synchronism.

17. An apparatus as defined in claim 3, wherein said mandrels have a quadratic cross section and further wherein said first and second folding and pressing means are of identical structure.

* * * * *